United States Patent [19]

Wendt

[11] Patent Number: 4,884,375

[45] Date of Patent: Dec. 5, 1989

[54] SYSTEM FOR MOUNTING FURNITURE ON WALLBOARD PARTITIONS

[75] Inventor: Alan C. Wendt, Barrington, Ill.

[73] Assignee: USG Interiors, Inc., Chicago, Ill.

[21] Appl. No.: 734,662

[22] Filed: May 16, 1985

[51] Int. Cl.[4] ..... A47B 57/10; E04B 2/60

[52] U.S. Cl. ..... 52/36; 52/241; 52/282; 248/297.2; 24/458

[58] Field of Search ..... 52/36, 729, 282, 39, 52/241, 712; 248/235, 224.4, 243, 297.2, 295.1; 211/90, 190, 207; 24/457, 458, 485, 570

[56] References Cited

U.S. PATENT DOCUMENTS

| | | | |
|---|---|---|---|
| 2,744,714 | 5/1956 | Parke | 248/245 |
| 3,087,586 | 4/1963 | Gray | 52/241 |
| 3,203,151 | 8/1965 | Branfsord, Jr. | 52/729 |
| 3,394,507 | 7/1968 | Dohe | 52/36 |
| 3,407,547 | 10/1968 | Dohe et al. | 52/729 |
| 3,668,827 | 6/1972 | Schwartz | 52/36 |
| 3,778,939 | 12/1973 | Nelsson | 52/36 |
| 3,782,048 | 1/1974 | Corman | 52/738 |
| 3,828,495 | 8/1974 | Law | 52/36 |
| 3,847,489 | 11/1974 | Van Riper | 248/297.2 |
| 4,231,197 | 11/1980 | Caplan et al. | 52/36 |
| 4,441,300 | 4/1984 | Varon et al. | 52/732 |

FOREIGN PATENT DOCUMENTS

| | | | |
|---|---|---|---|
| 2659818 | 10/1977 | Fed. Rep. of Germany | 248/295.1 |
| 3003176 | 8/1981 | Fed. Rep. of Germany | 24/458 |

OTHER PUBLICATIONS

Ceiling Dynamics, U.S. Gypsum Company, 1979.

*Primary Examiner*—Carl D. Friedman
*Assistant Examiner*—Caroline D. Dennison
*Attorney, Agent, or Firm*—Robert M. Didrick; Robert H. Robinson

[57] ABSTRACT

Hang-on furniture modules from various manufacturers differ in the placement of the hanger hooks extending from their back wall. A support cleat is frontally inserted in the unobstructed opening of a bifurcated, longitudinal channel at the edge of a stud in a partition. A longitudinal standard having a column of slots located to receive the hooks of a particular module is supported by the cleat as the standard straddles the stud in which the cleat is anchored.

6 Claims, 4 Drawing Sheets

SYSTEM FOR MOUNTING FURNITURE ON WALLBOARD PARTITIONS

This invention relates to a system for hanging furniture on wallboard partitions by means of hooks inserted into slotted standards fastened to studs in the partitions. It relates particularly to a system for fastening the standards to the studs. It relates more particularly to a cleat which projects from a stud and serves as a hanger for a standard.

In my co-pending, commonly assigned U.S. Pat. No. 4,570,390, filed Nov. 14, 1983, I disclose a stud having a web which is bifurcated once to form a longitudinal, screw-receiving groove and then again to form a longitudinal channel adapted to the frontal insertion of a slotted standard after the partition has been completed. Flanges extending laterally from the bifurcated web are adapted to support the individual panels of a wallboard partition. The stud and standard combination provides an excellent system for supporting shelves and furniture having brackets hooked into the slotted standards.

The furniture modules are made by the various manufacturers in popular widths which are adapted to the conventional 24 and 30 inch widths of movable partition panels. The inset of the hooks from the edges of the modules, however, may vary from about 1/64" to about 1", depending on the manufacturer. Thus, a wallhanger system in which the distance between the slotted standards is fixed by the need for conventional panel sizes must be modified to accommodate the different hook locations on the many furniture modules available to an interior designer.

It is an object of this invention, therefore, to provide a universal system for hanging furniture modules and the like on wallboard partitions.

It is another object of this invention to provide a system for the side-by-side mounting of bracket-mounted furniture modules and the like on a wallboard partition comprising studs having a narrow longitudinal channel in a bifurcated web and panels separated by the channel.

It is a related object of this invention to provide a support cleat for such a system whereby a slotted standard is fastened to a stud.

These and other objects which will become apparent from the following drawings and description are achieved by an improved system for hanging furniture and the like on a wallboard partition, the partition comprising:

a stud having a bifurcated web and flanges extending laterally from the web, the web having a plate portion and first and second longitudinal channel housings in tandem, the first channel being a screw-receiving groove proximate to the plate and the second channel being wider than the first and having an unobstructed mouth distal from the plate; and wallboard panels supported by the flanges and separated by the channel housings;

the improvement comprising:

a support cleat nested within the second channel housing, a screw passing through the cleat and into the groove, and a slotted standard straddling the second channel housing in abutment with the wallboard panels and supported by the cleat.

Turning now to the drawings.

Figure 1:
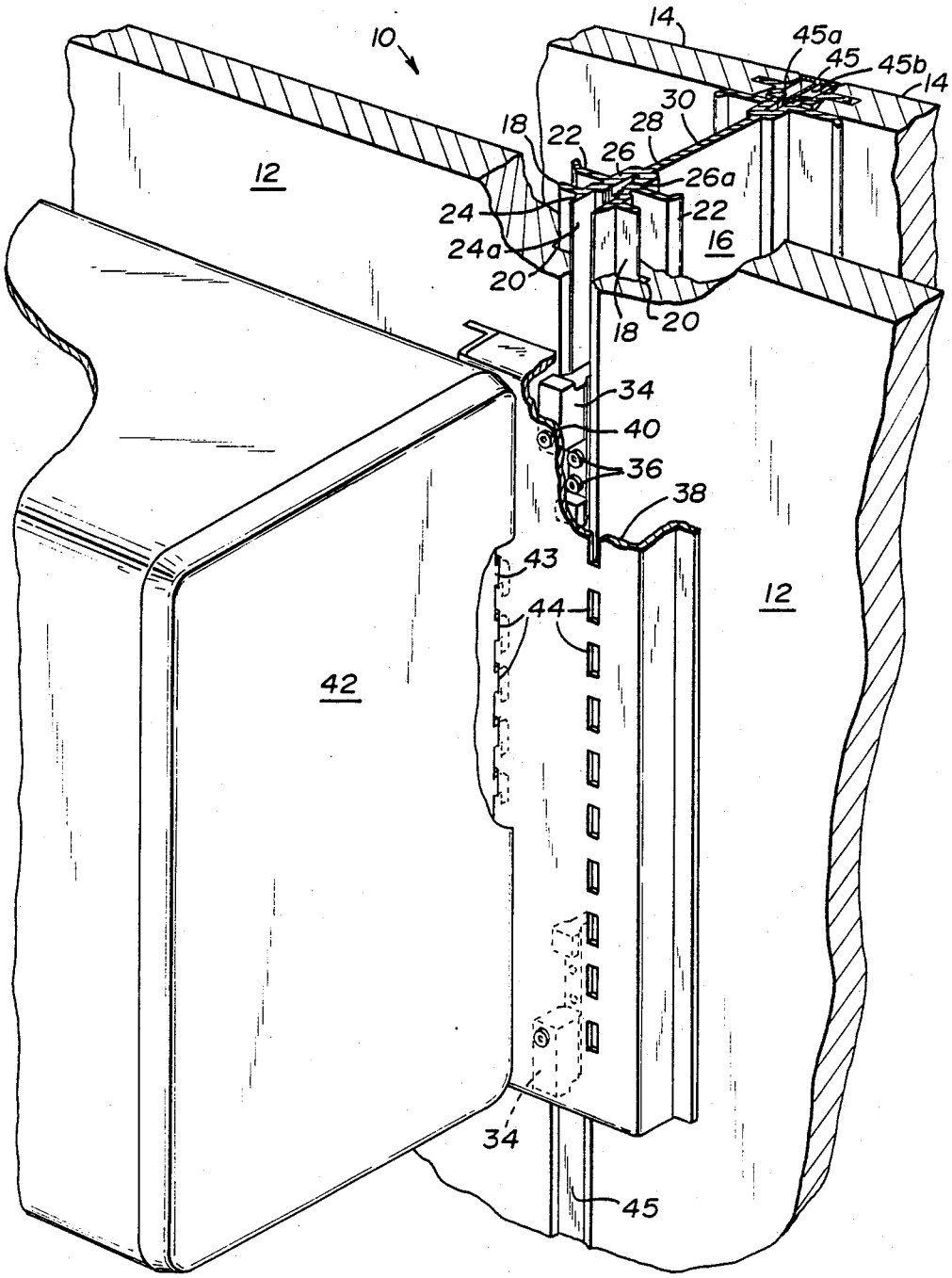
FIG. 1 is a perspective view of a wallboard partition in association with a furniture hanging system of this invention, both the partition and system being partially broken away.

In FIG. 1 the partition 10 comprises parallel arrays of the panels 12 and 14 supported by and separated transversely by, among others, the stud 16. The panels are attached to a stud 16 by insertion of the opposing kerf flanges 18 into the kerfs 20 and are braced by the opposing buttress flanges 22. The flanges 18 and 22 extend laterally from the channel housings 24 and 26, respectively, which are bifurcations of the plate 28 of the web 30. Adjacent panels 12 are separated laterally by the channel housings 24 and 26. Nested within the unobstructed channel **24*a* is the support cleat 34 which is fastened to the stud 16 by driving the screws 36 into the threaded groove 26*a*. The slotted standard 38 straddles the channel 24*a* in abutment with the panels 12 and is fastened to the cleat 34 by the screw 40 which also extends into the groove 26*a*. An inverted second cleat 34 at the opposite end of the standard 38 provides additional support and stability to the furniture module 42 as it hangs from the standard 38 with its hooks 43 inserted into the slots 44. The vinyl trim piece 45 spanning the gap between two adjacent panels 14 is secured within the longitudinally threaded groove 26*a* by the barbs 45*a* on the spline 45*b*. In like manner, another trim piece 45 spans the gap between adjacent panels 12 wherever the stud 16** is not being used to support furniture or shelves or the like.

Figure 2:
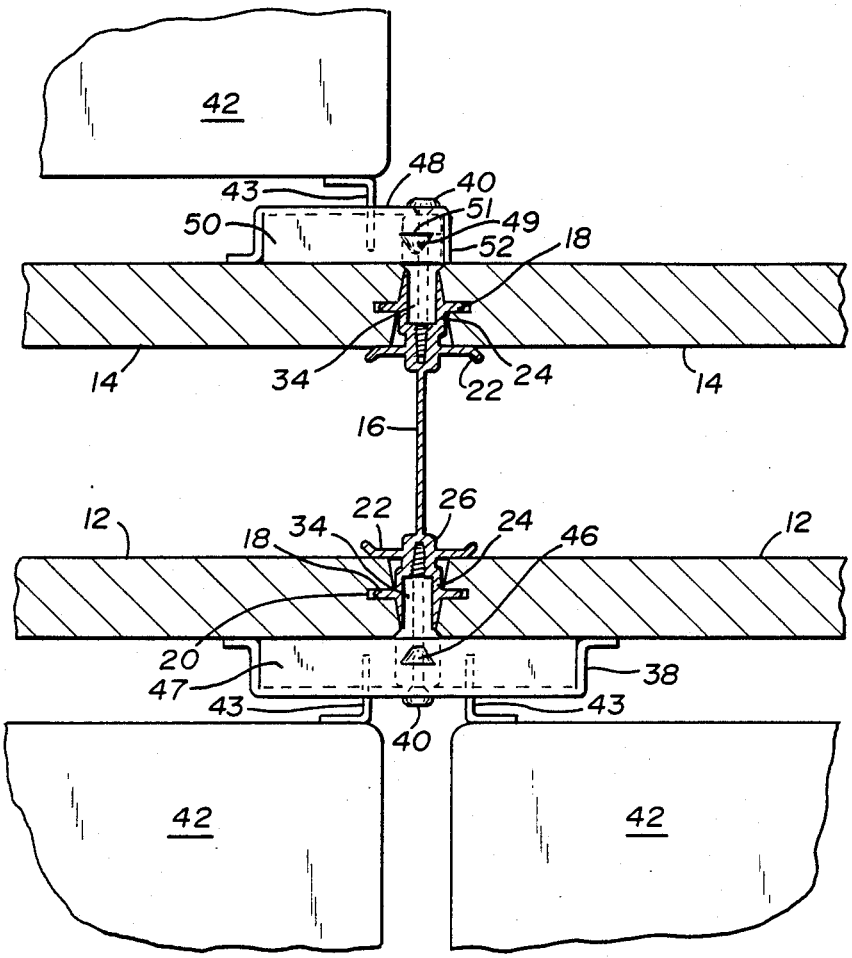
FIG. 2 is a plan view of a wallboard partition having furniture hung thereon according to this invention.
Figure 5:
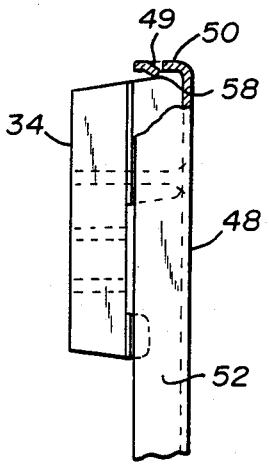
FIG. 5 is a side view of a slotted standard in engagement with the cleat.

FIG. 2 shows the nesting of the cleat 34 within the channel housing 24 and the fastening of the standard 38 to the cleat 34 and to the stud 16 by the screw 40 which is driven into the channel housing 26. The semi-conical detent 46, punched into the end cap 47, helps to hold the standard in place as shown in FIG. 5. The standard 38, having two columns of slots 44 located to accommodate the hooks of the particular furniture module to be hung, is used when it is desired to mount modules side-by-side. A single module 42 or the last of a series of modules may be hung on the partition when the standard 48 with only one column of slots is used. The semi-conical detent 49 in the end cap 50 is similar to the detent 46 but it is placed so that its apex 51 contacts the cleat 34 on the side distal to the side rail 52 of the standard 48. Such detents may be placed in end caps at both ends of the standard 48 so that it is reversible to hang furniture on either side of the stud 16.

Figure 3:
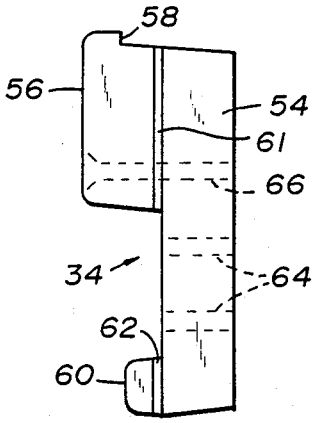
FIG. 3 is a side elevational view of the support cleat shown in FIGS. 1 and 2.
Figure 4:
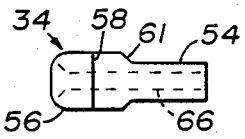
FIG. 4 is a plan view of the cleat of FIG. 3.
Figure 6:
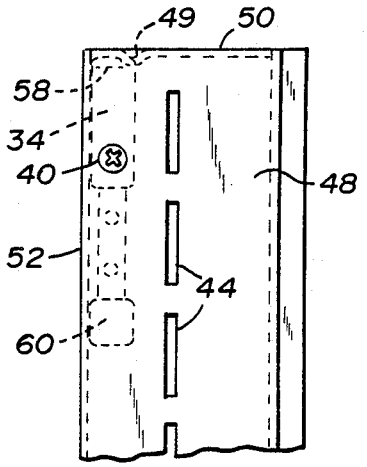
FIG. 6 is a front view of the standard in engagement with the cleat.

The cleat 34 in FIGS. 3 and 4 is a solid piece of metal or reinforced plastic formed by casting, machining, injection molding or other suitable technique. The spline 54 is shaped to nest within the channel **24*a* and serves as the base of the cleat. Projecting from the upper portion of the spline, the perch 56 is notched out to form the latch 58 and serves as the hanger for the slotted standard. Projecting from the bottom portion of the spline is the lug 60 which serves as a brace against the side rail 52 of the standard 48, as shown in FIG. 6, to prevent kinking of the rail in response to a torque in the standard set up by the outward vector of a load hanging on the standard. The shoulders 61 and 62 are beveled so that the beveled edges of the panels 12 and 14 are protected in the event that the cleat butts against the panels. The spline, perch, and lug have a common centerline which radially bisects the screw holes 64 and 66**.

FIG. 5 shows the latch 58 of the cleat 34 tucked up in front of the detent 49 in the end cap 50 of the standard 48. FIG. 6 shows the lug 60 of the cleat 34 in contact with the side rail 52 of the standard 48.

Figure 7:
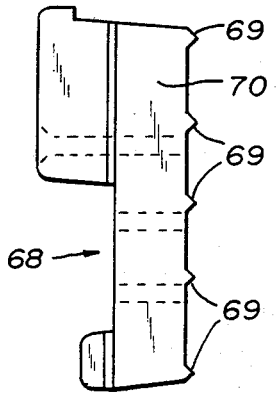
FIG. 7 is a side elevational view of a modified cleat.
Figure 8:
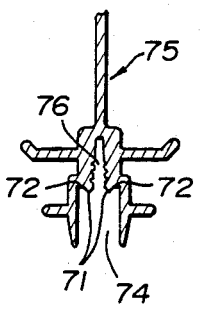
FIG. 8 is a plan view of a stud specially adapted to engage the cleat of FIG. 7.
Figure 9:
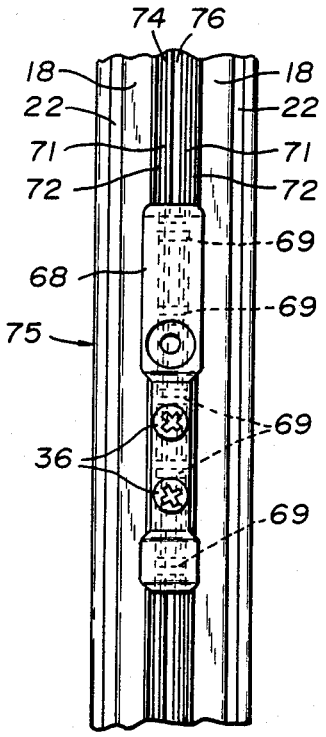
FIG. 9 is a front view of the cleat of FIG. 7 in engagement with a segment of the stud of FIG. 8.

In FIGS. 7, 8, and 9, the cleat 68 has a series of horizontal teeth 69 on the posterior side of the spline 70 which dig into the ridges 71 projecting from the ledges 72 of the channel housing 74 of the stud 75 as the scews 36 are driven into the groove 76.

Figure 10:
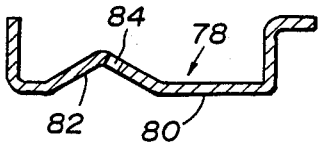
FIG. 10 is an end view of a modified standard useful in a particular embodiment of this invention.

The standard 78 in FIG. 10 accommodates hooks extending at an angle from a furniture module. The face plate 80 has a V-shaped recess 82 in which the slots 84 are located.

The system of this invention is incorporated in a wallboard partition by erecting a framework utilizing two or more of the studs 16, attaching the requisite number of the panels 12 and 14 to the framework, inserting the spline 54 of an upper support cleat 34 into the channel **24*a* of each stud 16, driving one or both of the screws 36 through the holes 64 and into the groove 26*a*, pushing the standard 38, for example, onto the perch 56 of the cleat 34 until the detent 46 drops behind the latch 58, and fastening the standard to the cleat and the channel housing 26 of the stud 16 with a screw 40. Extra support for the standard and its intended load may be provided by a second support cleat 34, turned end for end, at the opposite end of the standard. This inverted cleat is loosely connected to the standard by a screw 40 before the standard is mounted on the upper cleat. The partition is ready to support one or more furniture modules when the screws 40 have been driven into the stud 16**.

The subject matter claimed is:

1. An improved system for hanging furniture on a wallboard partition, the partition comprising a stud having a bifurcated web and flanges extending laterally from the web, the web having a plate portion and first and second longitudinal channel housings extending in tandem from the plate, the first channel housing being proximate to the plate and defining a screw-receiving groove, the second channel being wider than the first and having an unobstructed mouth distal to the plate, and wallboard panels supported by the flanges and separated laterally by the channel housings;

the improvement comprising a support cleat nested within the second channel housing, a screw passing through the cleat and into the groove, and an upright slotted standard straddling the second channel housing in abutment with the faces of the wallboard panels and supported by the cleat.

2. The system of claim 1 wherein the cleat has a basal spline which nests within the second channel housing and a perch anterior to the upper portion of the spline, said perch having a notch in the posterior portion of its top surface, the standard has an end cap and a detent in said end cap which fits over the notch in said perch and latches the standard to the cleat.

3. The system of claim 2 wherein the cleat is further characterized by a lug anterior to the lower portion of the spline and wider than the spline and the standard has a single column of slots and a side rail which contacts the lug.

4. The system of claim 2 wherein the standard has a single column of slots and the detent is a semi-conical depression in the end cap having an apex which is positioned between the centerline of the standard and the mid-point of the notch.

5. The cleat of claim 4 wherein the perch and the lug are wider than the spline and have beveled shoulders at the spline.

6. A cleat adapted for connection of a slotted standard with a supporting stud having a bifurcated web which defines a longitudinal channel along the edge of the stud, said cleat comprising a basal spline adapted to nest within the channel, a perch anterior to the upper portion of the spline and having a notch in the posterior portion of its top surface, and a lug anterior to the spline and spaced apart from the perch; the spline, perch, and lug having a common centerline and the cleat having an aperture which passes through the spline and is radially bisected by the centerline.

* * * * *